US012129725B2

(12) United States Patent
Hammer et al.

(10) Patent No.: US 12,129,725 B2
(45) Date of Patent: Oct. 29, 2024

(54) CLAMP FOR A CONTROL LINE, METHOD, AND SYSTEM

(71) Applicant: Baker Hughes Oilfield Operations LLC, Houston, TX (US)

(72) Inventors: Aaron C. Hammer, Houston, TX (US); John Wakefield, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 86 days.

(21) Appl. No.: 17/940,505

(22) Filed: Sep. 8, 2022

(65) Prior Publication Data

US 2024/0084656 A1 Mar. 14, 2024

(51) Int. Cl.
*E21B 23/06* (2006.01)
*E21B 33/127* (2006.01)
*E21B 34/06* (2006.01)

(52) U.S. Cl.
CPC ..... *E21B 23/06* (2013.01); *E21B 33/1277* (2013.01); *E21B 34/063* (2013.01)

(58) Field of Classification Search
CPC ..... E21B 23/06; E21B 33/1277; E21B 34/063
See application file for complete search history.

(56) References Cited

U.S. PATENT DOCUMENTS 4,098,334 A * 7/1978 Crowe ..... E21B 23/06 166/182
4,202,087 A * 5/1980 Wilderman ..... E21B 19/24 166/243
4,337,969 A * 7/1982 Escaron ..... E21B 17/026 174/136
4,603,578 A 8/1986 Stoltz
4,616,704 A * 10/1986 Johnston ..... E21B 17/1035 166/242.3

(Continued)

FOREIGN PATENT DOCUMENTS

WO 2016065244 A1 4/2016

OTHER PUBLICATIONS

Notification of Transmittal of the International Search Report and the Written Opinion of the International Searching Authority, or the Declaration; PCT/US2023/073637; Mail date: Jan. 4, 2024; 10 pages.

*Primary Examiner* — Steven A MacDonald
(74) *Attorney, Agent, or Firm* — CANTOR COLBURN LLP

(57) ABSTRACT

A clamp for a line including a body, and a control line contact surface, the clamp being responsive to a selected input to facilitate displacement of the line. An expandable tool including a component having a first dimension prior to activation and a second dimension after activation, a control line disposed adjacent the component, and a clamp initially securing the control line, the clamp comprising at least one of 1) a fastener and 2) a body, at least a portion of either of which being responsive to a selected input to facilitate displacement of the control line. A method for deploying a tool with a control line including securing the control line to the tool, reacting the at least a portion of the clamp to the input, and displacing the control line. A borehole system including a borehole in a formation, and an expandable tool disposed in the borehole.

24 Claims, 10 Drawing Sheets

(56) References Cited

U.S. PATENT DOCUMENTS 5,111,879 A * 5/1992 Jozwiak ..... E21B 33/03 166/93.1
5,217,071 A * 6/1993 Ferry ..... E21B 17/1035 166/242.3
5,311,936 A * 5/1994 McNair ..... E21B 43/14 166/117.6
6,173,788 B1 * 1/2001 Lembcke ..... E21B 33/128 166/387
6,367,845 B1 * 4/2002 Otten ..... F16L 15/001 285/119
6,581,692 B1 * 6/2003 Koch ..... E21B 21/019 166/85.1
7,431,082 B2 * 10/2008 Holt ..... E21B 17/1035 166/241.6
7,836,960 B2 11/2010 Patel et al.
7,997,338 B2 * 8/2011 Foster ..... E21B 33/1208 166/195
8,434,571 B2 * 5/2013 Kannan ..... E21B 17/1035 166/241.6
9,416,596 B2 * 8/2016 Maier ..... E21B 33/126
11,519,239 B2 * 12/2022 Greci ..... E21B 17/206
2002/0125008 A1 * 9/2002 Wetzel ..... E21B 47/135 166/278
2003/0168221 A1 9/2003 Zachman
2005/0171248 A1 * 8/2005 Li ..... E21B 33/12 524/35
2005/0279515 A1 * 12/2005 Cameron ..... E21B 17/1035 166/380
2007/0012436 A1 * 1/2007 Freyer ..... E21B 33/12 166/65.1
2007/0199693 A1 * 8/2007 Kunz ..... E21B 33/128 166/179
2008/0093090 A1 * 4/2008 Jaques ..... E21B 23/01 166/382
2009/0173505 A1 * 7/2009 Patel ..... E21B 33/1208 166/385
2009/0211767 A1 * 8/2009 Nutley ..... E21B 33/1208 277/336
2009/0277652 A1 * 11/2009 Nutley ..... E21B 33/1208 166/387
2010/0038074 A1 * 2/2010 Patel ..... E21B 33/1216 166/187
2010/0051271 A1 * 3/2010 Gano ..... E21B 33/1208 166/227
2011/0056702 A1 3/2011 Sharma et al.
2012/0024545 A1 2/2012 Kuo
2014/0014373 A1 1/2014 Richards
2014/0076540 A1 3/2014 Kang et al.
2018/0328151 A1 * 11/2018 Wakefield ..... E21B 43/088
2020/0399991 A1 * 12/2020 Duggan ..... E21B 23/01
2021/0123319 A1 * 4/2021 Greci ..... E21B 33/1208
2023/0135582 A1 * 5/2023 Aldejani ..... E21B 33/127 166/387
2023/0250703 A1 * 8/2023 Mair ..... H01B 11/1895 166/387

* cited by examiner

CLAMP FOR A CONTROL LINE, METHOD, AND SYSTEM

BACKGROUND

In the resource recovery and fluid sequestration industries there is often need to install tools that expand in the downhole environment. These can be packers, sand screens, etc. Deployments of such tools are commonplace, but all suffer when a control line is to be run outside of an element of the tool. Control lines are run in this way so that they are near the outside diameter of the tool when fully deployed such as in contact with or near the sand face of an open hole, and/or to allow continuous lines as opposed to cut lines running through equipment and then having splices (that increase time and potentially reduce reliability), for example. The art struggles with such deployments and therefore would well receive alternative constructions and methods for similar deployments.

SUMMARY

An embodiment of a clamp for a control line including a body, and a control line contact surface, at least a portion of the clamp being responsive to a selected input to facilitate displacement of the control line.

An embodiment of an expandable tool including a component having a first dimension prior to activation and a second dimension after activation, a control line disposed adjacent the component, and a clamp initially securing the control line, the clamp comprising at least one of 1) a fastener and 2) a body, at least a portion of either of which being responsive to a selected input to facilitate displacement of the control line.

An embodiment of a method for deploying a tool with a control line including securing the control line to the tool with a clamp reacting the at least a portion of the clamp to the input, and displacing the control line.

An embodiment of a borehole system including a borehole in a subsurface formation, and an expandable tool as disposed in the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
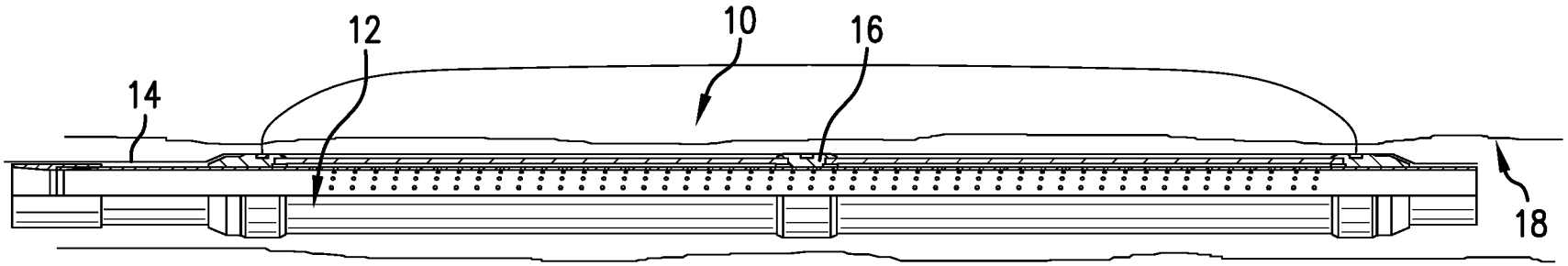
FIG. 1A is a ¾ section view of an expandable tool in a running condition.
Figure 1B:
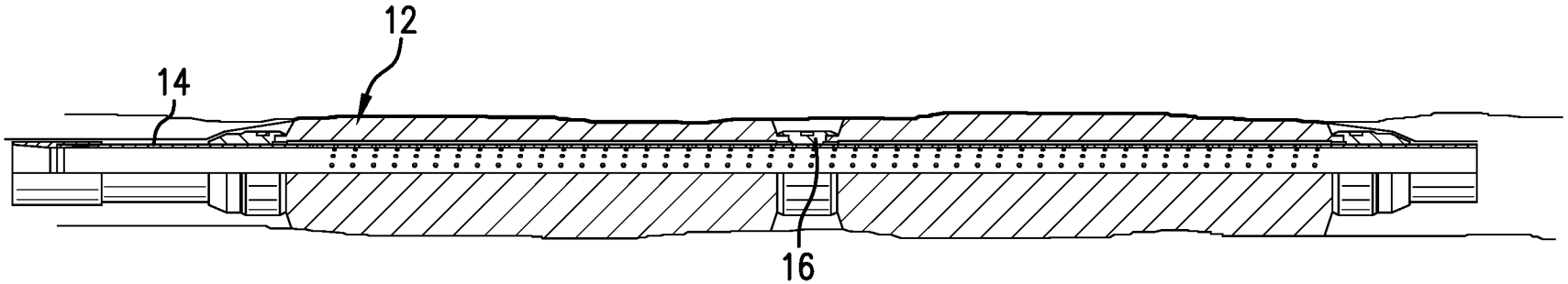
FIG. 1B is the tool of FIG. 1A in a deployed condition.

Referring to FIGS. 1A and 1B, a basic view of a tool 10 of the type disclosed herein is illustrated. The tool 10 includes an expandable component 12 that may be a packer element or a filtration element, for example. The element 12 is expandable in its radial dimension due to being formed of a shape memory polymer, a swellable material, a rubber material, deformable metal, etc. Also illustrated is a control line 14, that may be an electric line, an optic fiber line, a hydraulic line, combinations including one or more of the foregoing, etc. For example, a hydraulic line might be used for control, chemical injection, etc. while an electrical line might be used for monitoring or control). A fiber optic line might be used for monitoring, distributed temperature sensing or distributed acoustic sensing, for example. The line 14 is retained at one or more clamps 16 (disposed at end rings or between elements or within a span of elements) during run in.

The retention of control line 14 changes upon deployment pursuant to configurations disclosed herein. While a line 14 is characteristically robustly retained on tools 10 run in a borehole 18 to prevent damage during running, that very retention can become a problem during deployment. Comparing FIGS. 1A and 1B, one can easily perceive that were the line 14 held fast at clamp 16, it would be loaded quite strongly by the expanding element 12. Generally, control lines have greater tensile strength than elements 12 have internal pressure. Commonly then the line 14 will win and the element 12 will be damaged. It is also possible in some cases, however, that the line 14 could be bent or in some way degraded that would impact its function. Either condition is deleterious to the functionality of the tool 10 and hence detractive to the borehole system 50 in which the tool 10 is employed. In accordance with the teaching hereof, these drawbacks are avoided using clamps as disclosed herein.

Figure 2:
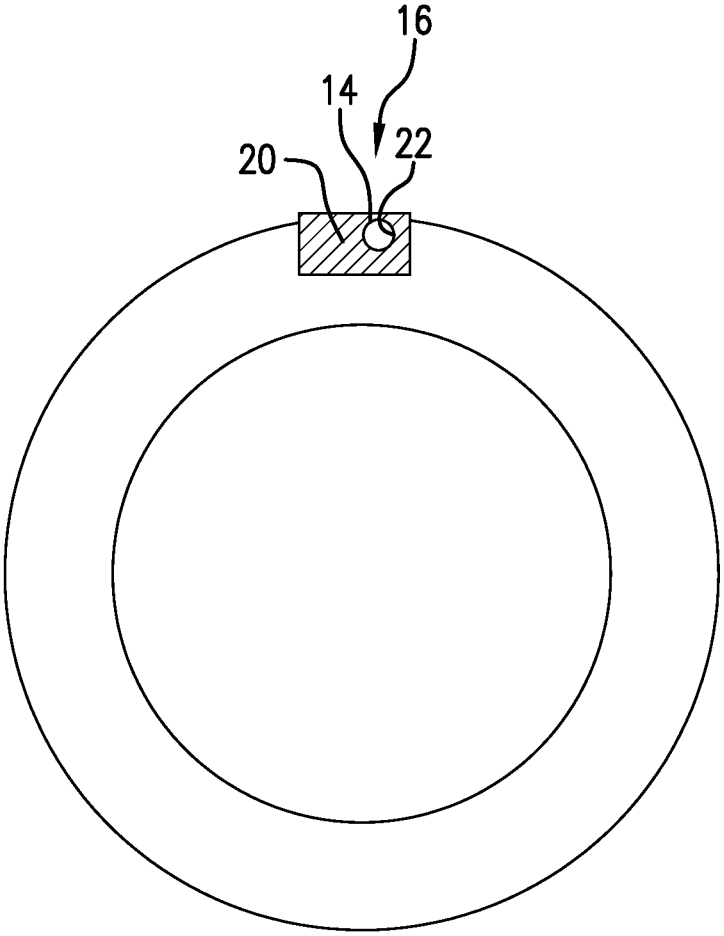
FIGS. 2-3 are schematic views of an embodiment of a control line clamp employed in FIGS. 1A and B.
Figure 3:
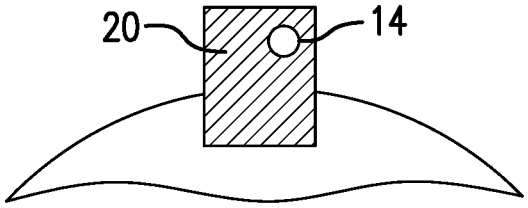

Referring to FIGS. 2-3, a first embodiment of clamp is illustrated. In this embodiment, the clamp 16 comprises a body 20 and a recess or contact surface 22 configured to engage the control line 14. The body 20 comprises, at least in part, a material that is itself expandable or degradable. The material may be the same material as the element 12 (shape memory polymer, or a swellable material, for example) or may be different in various embodiments. The material of the portion of the body 20 may also be composed of degradable material such as controlled electrolytic metallic material (available from Baker Hughes), other metallic materials known to degrade rapidly when exposed to particular fluids such as aluminum, zinc, magnesium, etc., polyglycolic acid, polyvinyl acetate, or polylactic acid to name a few. It is also contemplated that the body 20 is constructed to two different polymers adhered together such that a weakness is inherent at the interface of the two polymers. This could be accomplished through traditional formation or additive manufacture.

In any of these configurations, the material of the at least a portion of the body 20 may also be configured to react simultaneously, more quickly or more slowly to the same input that causes the element 12 to react or may react differently to that same input. For example, a reaction fluid that causes a shape memory polymer of the element 12 to expand may cause a material of the body 20 to degrade. In the event the material of the at least a portion of the body 20 reacts to a different input than the input to which element 12 reacts, then in some embodiments, the input will be applied or allowed prior to the time that the input to which element 12 reacts is applied or allowed. Inputs to which the element 12 or body 20 react include borehole parameters such as temperature, pressure (ambient or applied), and type of fluid in the borehole 18 along with the amount of time of exposure to that fluid, applied fluids such as for example a acids, solvents, brines, oils, alcohol, ketones, etc. and combinations including one or more of the foregoing. In all cases, the result is that the control line is displaced with the element 12 rather than hindered by the clamp 16.

Still referring to FIGS. 2-3, the body 20 is illustrated in a first condition in FIG. 2 where it is compacted and retaining the line 14 therein in the appropriate position (analogous to the position in FIG. 1A). In the FIG. 3 view, the body 20 has expanded and shifted the line 14 away from a center axis of the tool 10. Hence the line 14 is permitted to assume the position analogous to FIG. 1B. Each of the expanding embodiments referenced above are illustrated schematically by these views.

Figure 3A:
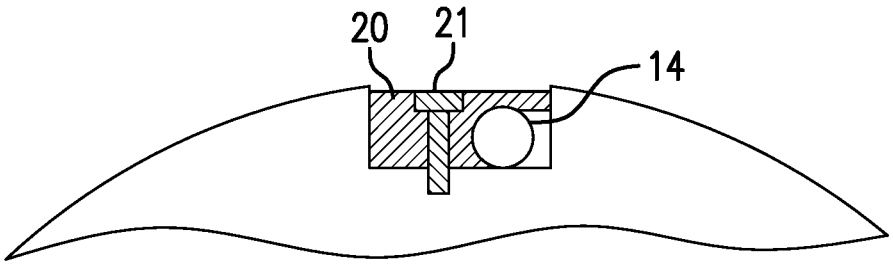
FIG. 3A is an alternate clamp embodiment.

Referring to FIG. 3A, an alternative arrangement allows body 20 to be metallic and non-responsive to the input (or it could be additionally responsive to the input) and a fastener 21 secures the body 20 to another structure. The fastener 21 may comprise in at least a portion thereof, a material responsive to the input. The fastener may be weakened or degraded or may completely disappear in response to the input. Upon the fastener responding to the input, the body will be unsecured and the control line 14 will be free to move with the element.

Figure 4:
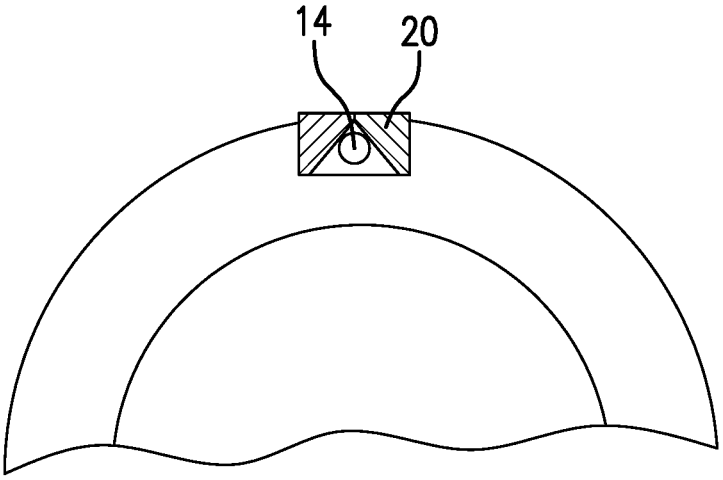
FIGS. 4 and 5 are schematic views of an alternate clamp.
Figure 5:
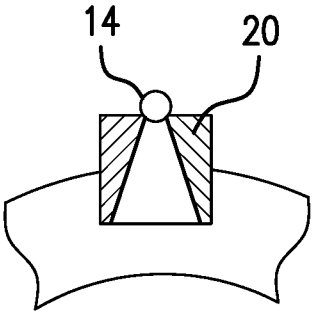

Alternatively, referring to FIGS. 4 and 5, the body 20 may be configured to release the line 14 upon responding to the input. Specifically, the body 20 in this embodiment is weakened such that it simply does not present resistance to the line 14 moving out of engagement therewith. The line 14 is no longer retained in the view of FIG. 5 and thereby allowed to be displaced through the action of the element 12 expanding. This too allows the line to assume the position illustrated in FIG. 1B. Each of the parting embodiments referenced above are illustrated schematically by these views.

Figure 6:
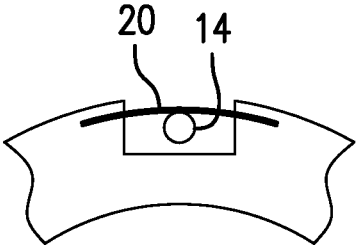
FIGS. 6-8 are schematic views of another alternate clamp.
Figure 7:
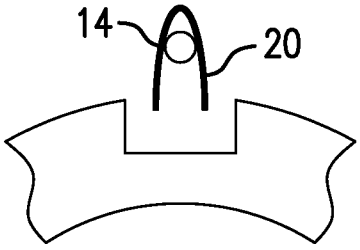
Figure 8:
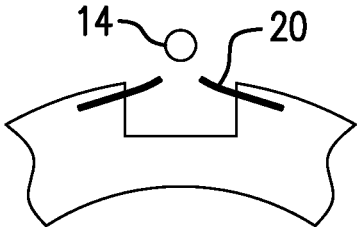

Referring to FIGS. 6-8. The body 20 is configured to respond to an input by weakening of the material of body 20. FIG. 6 illustrated the body 20 prior to input whereby the line 14 is retained. After input, the body weakens or softens and will either stretch and deform to allow the line 14 to follow the expansion of element 12 or may simply rupture when the element 12 puts a load on the line 14. Each of the stretching or releasing embodiments referenced above are illustrated schematically by these views.

In a variation of any of the above discussed embodiments, the body 20 might be formed from thin struts instead of a full volume of material thereby allowing an even greater surface area contact with the body 20 and reducing tensile strength of the body to resist expansion loads from the element 12. Similarly, to enhance degradation or weakening of the body 20, it is contemplated that layers of material of body 20 be deposited at significantly different temperatures (for example 203 F* and 149 F*).

Figure 9:
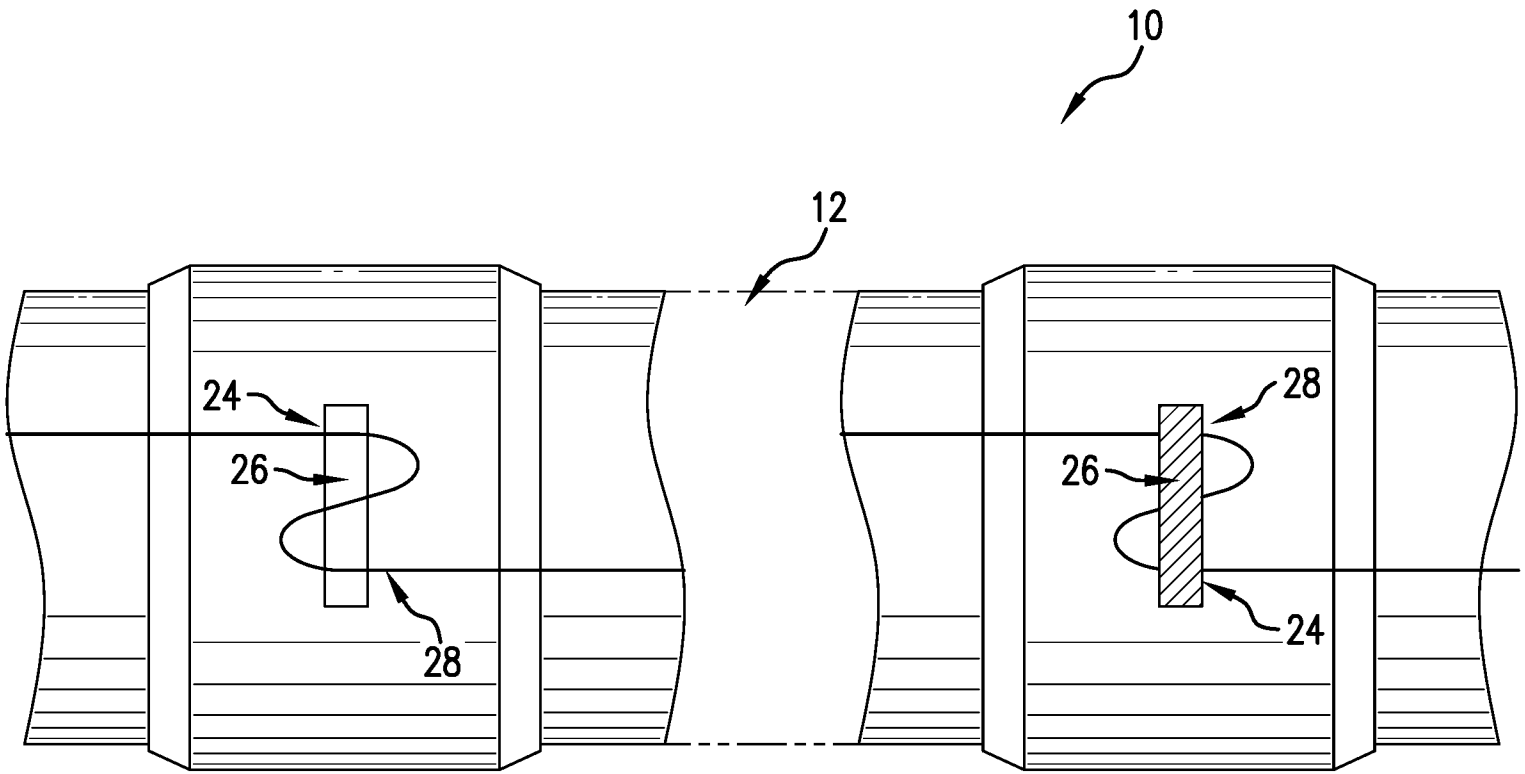
FIG. 9 is a schematic view illustrating an alternate control line routing used in connection with any of the other embodiments disclosed herein.

Referring to FIG. 9, a line routing is illustrated. This routing creates excess line 14 in the vicinity of the expandable element 12 thereby allowing for that expansion without hinderance from the line 14 being retained. In this embodiment the line is retained in one part 24 of a clamp 26 and simply lightly restrained in the other part 28 thereof. Any of the clamp embodiments hereinabove may be used in this embodiment modified to provide the parts 24 and 28 functionality.

The tool 10 described herein may be run in open hole or in cased hole and where sensory function is desired the line 14 is caused by the actions of the clamp 16 and element 12 herein to come near or into contact with the inside diameter of the borehole 18 or the casing within that borehole 18. Further, the tool 10 is beneficially useful for hydraulic lines to protect the hydraulic line or the element from each other during the setting process.

Figure 10:
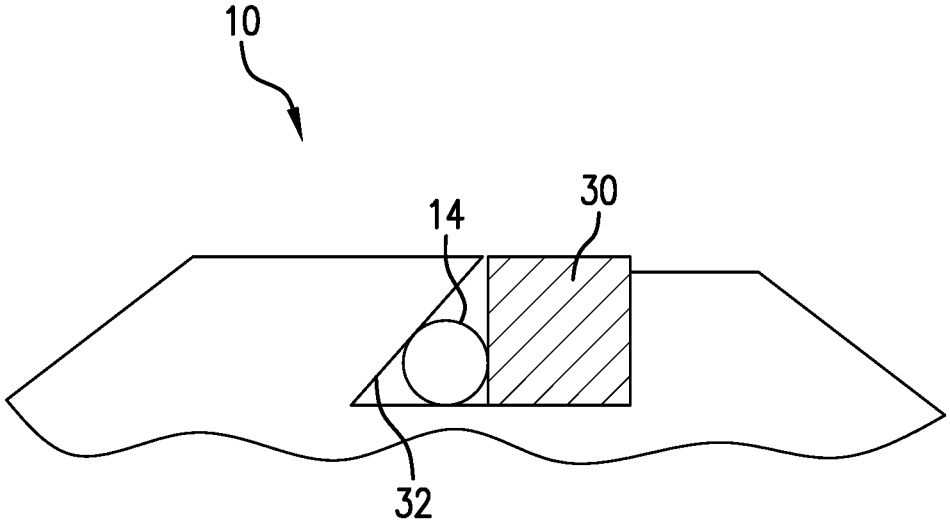
FIG. 10 is a schematic view of an alternate body for the clamp.

Referring to FIG. 10, a construction is illustrated that can be applied to any of the embodiments hereof. This is where a body 30 is a weakenable or degradable material but does not include a recess or at least not all of the recess. Rather, in this embodiment, the body 30 acts more like a gate and a portion of tool 10 acts as the recess 32. The line 14 is trapped in the recess 32 until the body 30 degrades enough to allow the line 14 to escape the recess 32 under the load created by the expanding element.

Figure 11:
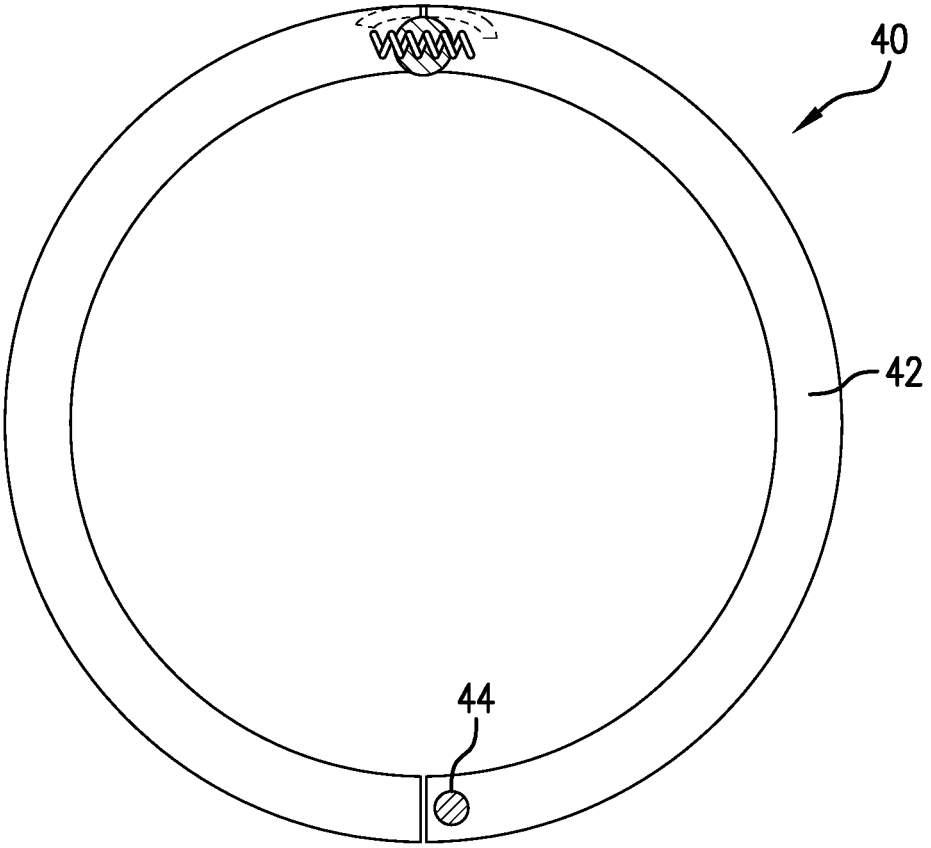
FIGS. 11 and 12 are two positions of another alternate embodiment of a control line clamp.
Figure 12:
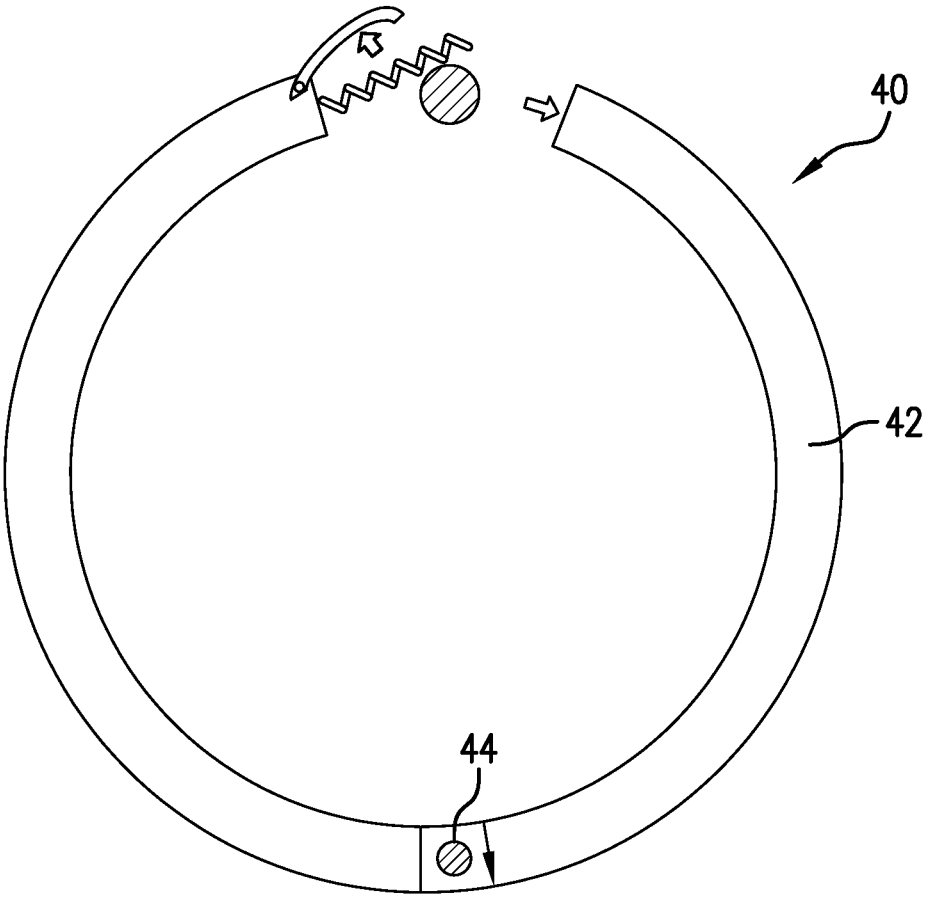
Figure 13:
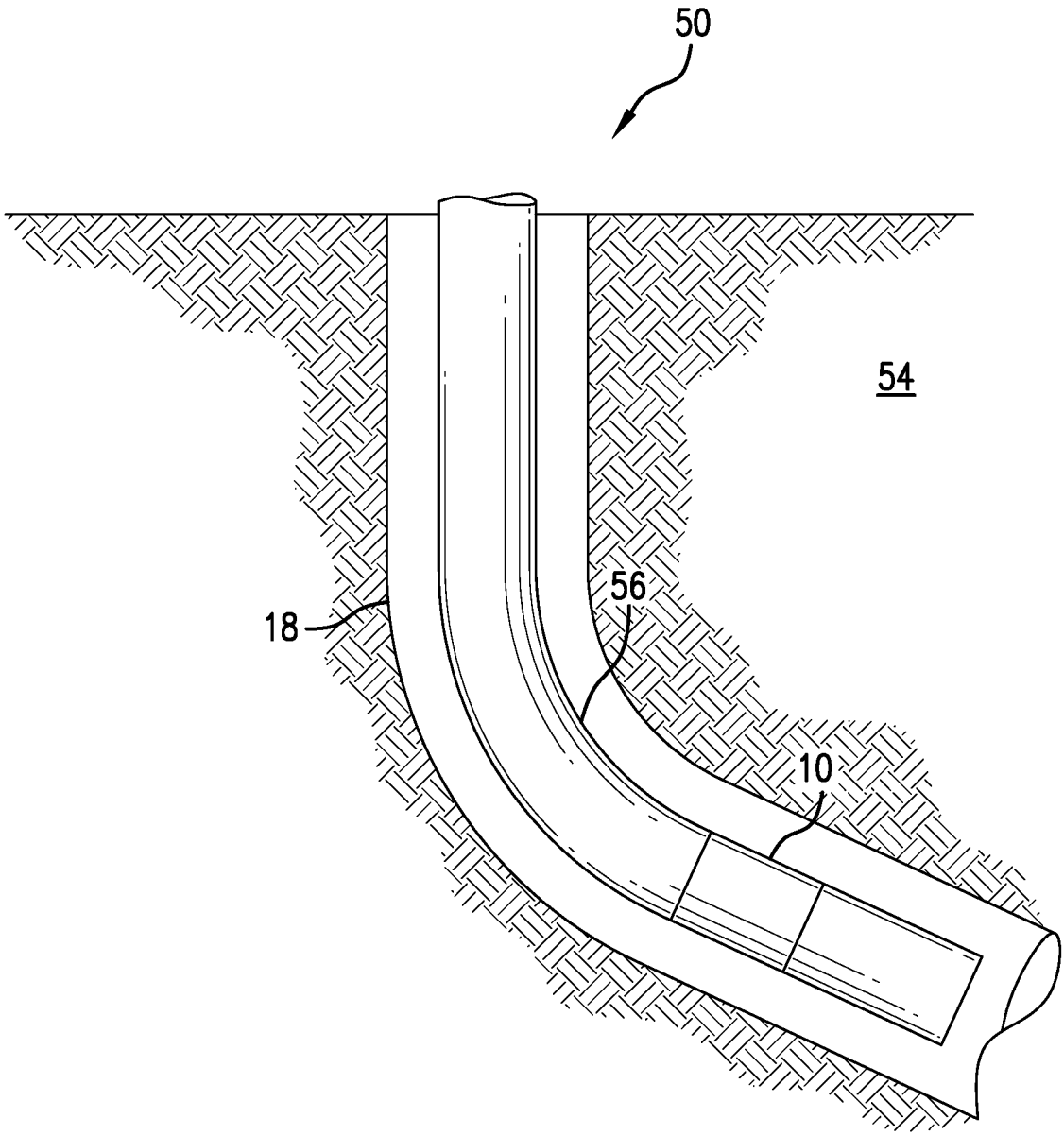
FIG. 13 is a view of a borehole system including a tool using the clamp as disclosed herein.

Referring to FIGS. 11 and 12, an alternate embodiment of control line clamp 40, that is employable on the tool 10, is illustrated in a line retained position and a line released position, respectively. The configuration 40 employs a clamshell 42 having a hinge pin 44 opposite a clamp body 46. Clamp body 46 retains the clamshell 42 in a closed position and traps the line 14 radially inwardly of the clamp body 46. A spring 48 is maintained in a compressed condition when the configuration 40 is in the line retained position. The clamp body 46 comprises a material similar to others of the disclosure hereof that degrades in response to environmental factors such as heat, fluids, time, etc. When the clamp body 46 is sufficiently degraded, it will release. Once the clamp body 46 releases, the clamp moves to the position illustrated in FIG. 12 wherein the line 14 is released. Referring to FIG. 13, a borehole system 50 is illustrated. The system 50 comprises the borehole 18 in a subsurface formation 54. A string 56 is disposed within the borehole 18. A tool 10 as described herein is disposed as a part of the string 56.

Set forth below are some embodiments of the foregoing disclosure:

Embodiment 1: A clamp for a control line including a body, and a control line contact surface, at least a portion of the clamp being responsive to a selected input to facilitate displacement of the control line.

Embodiment 2: The clamp as in any prior embodiment wherein the selected input is a fluid.

Embodiment 3: The clamp as in any prior embodiment wherein the selected input is a downhole parameter.

Embodiment 4: The clamp as in any prior embodiment wherein the at least a portion of the clamp is a fastener configured for securement of the body to another component.

Embodiment 5: The clamp as in any prior embodiment wherein the at least a portion of the clamp is at least a portion of the body.

Embodiment 6: The clamp as in any prior embodiment wherein the at least a portion of the body is a weakenable material responsive to the input.

Embodiment 7: The clamp as in any prior embodiment wherein the weakenable material is stretchable upon weakening.

Embodiment 8: The clamp as in any prior embodiment wherein the weakenable material is rupturable upon weakening.

Embodiment 9: The clamp as in any prior embodiment wherein the at least a portion of the clamp is expandable material.

Embodiment 10: An expandable tool including a component having a first dimension prior to activation and a second dimension after activation, a control line disposed adjacent the component, and a clamp initially securing the control line, the clamp comprising at least one of 1) a fastener and 2) a body, at least a portion of either of which being responsive to a selected input to facilitate displacement of the control line.

Embodiment 11: The tool as in any prior embodiment wherein the component comprises expandable material.

Embodiment 12: The tool as in any prior embodiment wherein the at least a portion comprises a material that reacts to the same input to which the component reacts.

Embodiment 13: The tool as in any prior embodiment wherein the component reacts to the input more quickly than the at least a portion of either the fastener or the body does.

Embodiment 14: The tool as in any prior embodiment wherein the component reacts to the input more slowly than the at least a portion of either the fastener or the body does.

Embodiment 15: The tool as in any prior embodiment wherein the component is a packer element.

Embodiment 16: The tool as in any prior embodiment wherein the component is a filter element.

Embodiment 17: A method for deploying a tool with a control line including securing the control line to the tool with a clamp as in any prior embodiment, reacting the at least a portion of the clamp to the input, and displacing the control line.

Embodiment 18: The method as in any prior embodiment wherein the displacing is into contact with an inside dimension of a structure disposed outwardly of the tool.

Embodiment 19: The method as in any prior embodiment wherein the displacing is with the clamp.

Embodiment 20: The method as in any prior embodiment wherein the displacing is with an element of the tool.

Embodiment 21: A borehole system including ga borehole in a subsurface formation, and an expandable tool as in any prior embodiment disposed in the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, production, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A clamp for a control line comprising:

a body having a line retention condition and a line release condition; and a control line contact surface, at least a portion of the clamp being responsive to a selected input to alter the body from the line retention condition to the line release condition to thereby facilitate displacement of the control line during expansion of an expandable element.

2. The clamp as claimed in claim 1 wherein the selected input is a fluid.

3. The clamp as claimed in claim 1 wherein the selected input is a downhole parameter.

4. The clamp as claimed in claim 1 wherein the at least a portion of the clamp is a fastener configured for securement of the body to another component.

5. The clamp as claimed in claim 1 wherein the at least a portion of the clamp is at least a portion of the body.

6. The clamp as claimed in claim 5 wherein the at least a portion of the body is a weakenable material responsive to the input.

7. The clamp as claimed in claim 6 wherein the weakenable material is stretchable upon weakening.

8. The clamp as claimed in claim 6 wherein the weakenable material is rupturable upon weakening.

9. The clamp as claimed in claim 1 wherein the at least a portion of the clamp is expandable material.

10. A method for deploying a tool with a control line comprising:

securing the control line to the tool with a clamp as claimed in claim 1;

reacting the at least a portion of the clamp to the input; and displacing the control line.

11. The method as claimed in claim 10 wherein the displacing is into contact with an inside dimension of a structure disposed outwardly of the tool.

12. The method as claimed in claim 10 wherein the displacing is with the clamp.

13. The method as claimed in claim 10 wherein the displacing is with an element of the tool.

14. An expandable tool comprising:

a component having a first dimension prior to activation and a second dimension after activation;

a control line disposed adjacent the component, the control line displacing during activation of the component; and a clamp initially securing the control line, the clamp comprising at least one of 1) a fastener and 2) a body, at least a portion of either of which being responsive to a selected input to release the control line.

15. The tool as claimed in claim 14 wherein the component comprises expandable material.

16. The tool as claimed in claim 14 wherein the component is a packer element.

17. The tool as claimed in claim 14 wherein the component is a filter element.

18. A borehole system comprising:

a borehole in a subsurface formation; and an expandable tool as claimed in claim 14 disposed in the borehole.

19. An expandable tool comprising:

a component having a first dimension prior to activation and a second dimension after activation, wherein the component comprises expandable material;

a control line disposed adjacent the component; and a clamp initially securing the control line, the clamp comprising at least one of 1) a fastener and 2) a body, at least a portion of either of which being responsive to a selected input to release the control line wherein the at least a portion comprises a material that reacts to the same input to which the component reacts.

20. The tool as claimed in claim 19 wherein the component reacts to the input more quickly than the at least a portion of either the fastener or the body does.

21. The tool as claimed in claim 19 wherein the component reacts to the input more slowly than the at least a portion of either the fastener or the body does.

22. A method for deploying a tool with a control line comprising:

securing the control line to the tool with a clamp comprising:

a body having a line retention condition and a line release condition; and a control line contact surface, at least a portion of the clamp being responsive to a selected input to alter the body from the line retention condition to the line release condition to thereby facilitate displacement of the control line;

reacting the at least a portion of the clamp to the input; and displacing the control line, wherein the displacing is into contact with an inside dimension of a structure disposed outwardly of the tool.

23. A method for deploying a tool with a control line comprising:

securing the control line to the tool with a clamp comprising:

a body having a line retention condition and a line release condition; and a control line contact surface, at least a portion of the clamp being responsive to a selected input to alter the body from the line retention condition to the line release condition to thereby facilitate displacement of the control line;

reacting the at least a portion of the clamp to the input; and displacing the control line, wherein the displacing is with the clamp.

24. An expandable tool comprising:

a component having a first dimension prior to activation and a second dimension after activation, wherein the component comprises expandable material;

a control line disposed adjacent the component; and a clamp initially securing the control line, the clamp comprising at least one of 1) a fastener and 2) a body, at least a portion of either of which being responsive to a selected input to release the control line, wherein the component is a filter element.

* * * * *